US006673160B2

(12) United States Patent
Stathem et al.

(10) Patent No.: US 6,673,160 B2
(45) Date of Patent: Jan. 6, 2004

(54) METHOD OF CLEANING FOR AN INKJET PRINTER

(75) Inventors: Ralph L Stathem, Vancouver, WA (US); John R. Carnes, Corvallis, OR (US); Kevin Almen, Albany, OR (US); Babak Honaryar, Carlsbad, CA (US); Kris M. English, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 240 days.

(21) Appl. No.: 09/777,307

(22) Filed: Feb. 5, 2001

(65) Prior Publication Data

US 2001/0005538 A1 Jun. 28, 2001

Related U.S. Application Data

(62) Division of application No. 09/240,288, filed on Jan. 29, 1999, now abandoned.

(51) Int. Cl.[7] ..... B08B 7/00

(52) U.S. Cl. ..... 134/6; 134/9; 134/15; 134/26; 15/104.94; 355/215

(58) Field of Search ..... 134/6, 9, 15, 26; 15/104.94; 355/215; 346/140 R; 347/28

(56) References Cited

U.S. PATENT DOCUMENTS

| | | | | |
|---|---|---|---|---|
| 4,357,615 | A | 11/1982 | Yoshiharu et al. | 346/134 |
| 4,408,241 | A | 10/1983 | Ogawa | 360/128 |
| 4,515,466 | A | 5/1985 | Heisler | 355/15 |
| 4,611,361 | A | 9/1986 | Shinkai | 15/104.93 |
| 4,628,388 | A | 12/1986 | Kawabe | 360/128 |
| 4,686,132 | A | 8/1987 | Sumii et al. | 428/171 |
| 4,933,015 | A | 6/1990 | White | 134/6 |
| 5,075,919 | A | 12/1991 | Rogers | 15/210 R |
| 5,153,964 | A | 10/1992 | Gelardi et al. | 15/229.12 |
| 5,223,329 | A | 6/1993 | Amann | 428/198 |
| 5,227,844 | A | 7/1993 | Bhattacharjee et al. | 355/215 |
| 5,239,316 | A | 8/1993 | Demarchi et al. | 346/140 R |
| 5,300,958 | A | 4/1994 | Burke et al. | 346/140 R |
| 5,560,980 | A | 10/1996 | Sakaki et al. | 428/195 |
| 5,564,970 | A | 10/1996 | Olson et al. | 451/428 |
| 5,589,865 | A | 12/1996 | Beeson | 347/28 |
| 5,754,197 | A | 5/1998 | Shibata | 347/22 |
| 5,864,348 | A | 1/1999 | Fritsch et al. | 347/22 |
| 5,949,448 | A | 9/1999 | Man et al. | 347/33 |
| 6,151,044 | A | * 11/2000 | Gaasch | 347/33 |

FOREIGN PATENT DOCUMENTS

| | | | |
|---|---|---|---|
| EP | 0774361 A1 | 5/1997 | |
| GB | 1426930 | 3/1976 | B41N/3/00 |
| JP | 63111076 | 5/1988 | B41J/29/00 |
| JP | 10226097 | 8/1998 | B41J/2/32 |
| JP | 000033749 | 2/2000 | A47L/13/16 |

OTHER PUBLICATIONS

Larry A. Jackson, et al., "DeskJet Printer Chassis and Mechanism Design," Hewlett–Packard Journal, Oct. 1988, pp 66–75.

Michael T. Dangelo, et al., "Print Cartridge Fixturing and Maintenance in the HP DeskJet 100C Printer," Hewlett–Packard Journal, Feb. 1994, pp 67–71.

* cited by examiner

*Primary Examiner*—Randy Gulakowski
*Assistant Examiner*—Gentle E Winter
(74) *Attorney, Agent, or Firm*—Raymond A. Jenski

(57) ABSTRACT

In order that sensitive structures of inkjet printing mechanisms be cleaned without damaging these structures, a cleaning sheet and a process of using the sheet has been created. Debris and dried ink is removed from print cartridges and their carriage using a cleaning sheet having two strips of material spaced with a napped surface disposed longitudinally between the side edges and spaced apart from each other. By controlling the distance the strips are spaced from the sheet feed edge of the cleaning sheet, the print cartridges can be placed adjacent the strips for scrubbing against the strips without resulting in a media jam in the printer due to the increased thickness of the cleaning sheet.

7 Claims, 6 Drawing Sheets

METHOD OF CLEANING FOR AN INKJET PRINTER

CROSS REFERENCE TO RELATED APPLICATION(S)

This is a divisional of application Ser. No. 09/240,288 filed on Jan. 29, 1999.

BACKGROUND OF THE INVENTION

The present invention is generally related to a cleaner kit for an inkjet printer and is more particularly related to a specially prepared medium which is inserted in the paper path of a printer and an operational program for the printer which causes the print cartridge and associated carriage mechanism to wipe across the specially prepared medium in a way which removes accumulated ink, fibers, and other trapped debris.

Simply stated, inkjet printers operate by expelling a small volume of ink through a plurality of small orifices in an orifice plate held in proximity to a paper or other medium upon which printing or marks are to be placed. These orifices are arranged in a fashion in the orifice plate such that the expulsion of droplets of ink from a selected number of orifices relative to a particular position of the medium results in the production of a portion of a desired character or image. Controlled repositioning of the orifice plate or the medium followed by another expulsion of ink droplets results in the creation of more segments of the desired character or image. Furthermore, inks of various colors may be coupled to individual arrangements of orifices so that selected firing of the orifices can produce a multi-colored image by the inkjet printer.

Several mechanisms have been employed to create the force necessary to expel an ink droplet from a printhead, among which are thermal, piezoelectric and electrostatic mechanisms. While the following explanation is made with reference to a thermal inkjet expulsion mechanism, the present invention may have application for the other ink expulsion mechanisms as well.

Expulsion of the ink droplet in a conventional thermal inkjet printer is a result of rapid thermal heating of the ink to a temperature that exceeds the boiling point of the ink solvent to create a vapor phase bubble of ink. Such rapid heating of the ink is generally achieved by passing a pulse of electric current, typically for a few microseconds, through an ink ejector that is typically an individually addressable heater resistor. The heat generated thereby is applied to a small volume of ink held in an enclosed area associated with the heater resistor and which is generally referred to as a firing chamber. For a printhead, there are a plurality of heater resistors and associated firing chambers—perhaps numbering in the hundreds—each of which can be uniquely addressed and caused to eject ink upon command by the printer. The heater resistors are deposited in a semiconductor substrate and are electrically connected to external circuitry by way of metalization deposited on the semiconductor substrate. Further, the heater resistors and metalization may be protected from chemical attack and mechanical abrasion by one or more layers of hard and non-reactive passivation. Additional description of basic printhead structure may be found in "The Second-Generation Thermal Inkjet Structure" by Ronald Askeland, et al. in the Hewlett-Packard Journal, August 1988, pages 28–31. Thus, one of the boundary walls of each firing chamber consists of the semiconductor substrate (and typically one firing resistor). Another of the boundary walls of the firing chamber, disposed opposite the semiconductor substrate in one common implementation, is formed by a foraminous orifice plate. Generally, each of the orifices in this orifice plate is arranged in relation to a heater resistor in a manner in which enables ink to be directly expelled from the orifice. As the ink vapor nucleates at the heater resistor and expands, it displaces a volume of ink which forces a lesser volume of ink out of the orifice for deposition of the medium. The bubble then collapses and the displaced volume of ink is replenished from a larger ink reservoir by way of an ink feed channel in one of the boundary walls of the firing chamber.

Not all of the expelled ink leaves the print cartridge and is deposited upon the medium, however. A small quantity of ink remains on the print head in puddles in the area near the ejecting orifices. Also, small satellite droplets and aerosols that separate from the main drop can remain airborne for a period of time before setting, undesirably, on surfaces within the printer.

Conventionally, inkjet printers are fitted with a device termed a service station, which among other things, wipes debris and puddled ink off of the printhead on a regular basis. Even though cleaning operations are regularly and automatically undertaken by the printer, ink residue will accumulate within the printer. See, for example "Print Cartridge Fixturing and Maintenance in the HP DeskJet 1200c Printer" by Michael T. Dangelo et al. Hewlett-Packard Journal, February 1994, pp. 67–71 and U.S. Pat. No. 5,300,958, "Method and Apparatus For Automatically Cleaning the Printhead of a Thermal Inkjet Cartridge". Despite this cleaning effort, a print head service station may not be able to clean accumulated ink and debris from all surfaces of the print cartridge or its carriage and transport mechanism. With the passage of time the debris builds up on cartridge and carriage mechanism to an extent that print quality can suffer ill effects from the debris. One common degredation which has been observed is the dragging by the carriage of fibers accumulated in the debris through recently printed (and wet) ink drops on the medium. The resultant print is one which includes an undesirable trace of ink passing through the printed material.

SUMMARY OF THE INVENTION

A cleaner for an inkjet printer includes a sheet medium having first and second sides, a sheet feed edge, and two side edges. A first strip of material having a napped surface is affixed to the first side of the sheet medium, disposed longitudinally between the two side edges, and disposed parallel to and a first predetermined distance from the sheet feed edge.

DETAILED DESCRIPTION OF THE PREFERRED EMBODIMENTS

Figure 1:
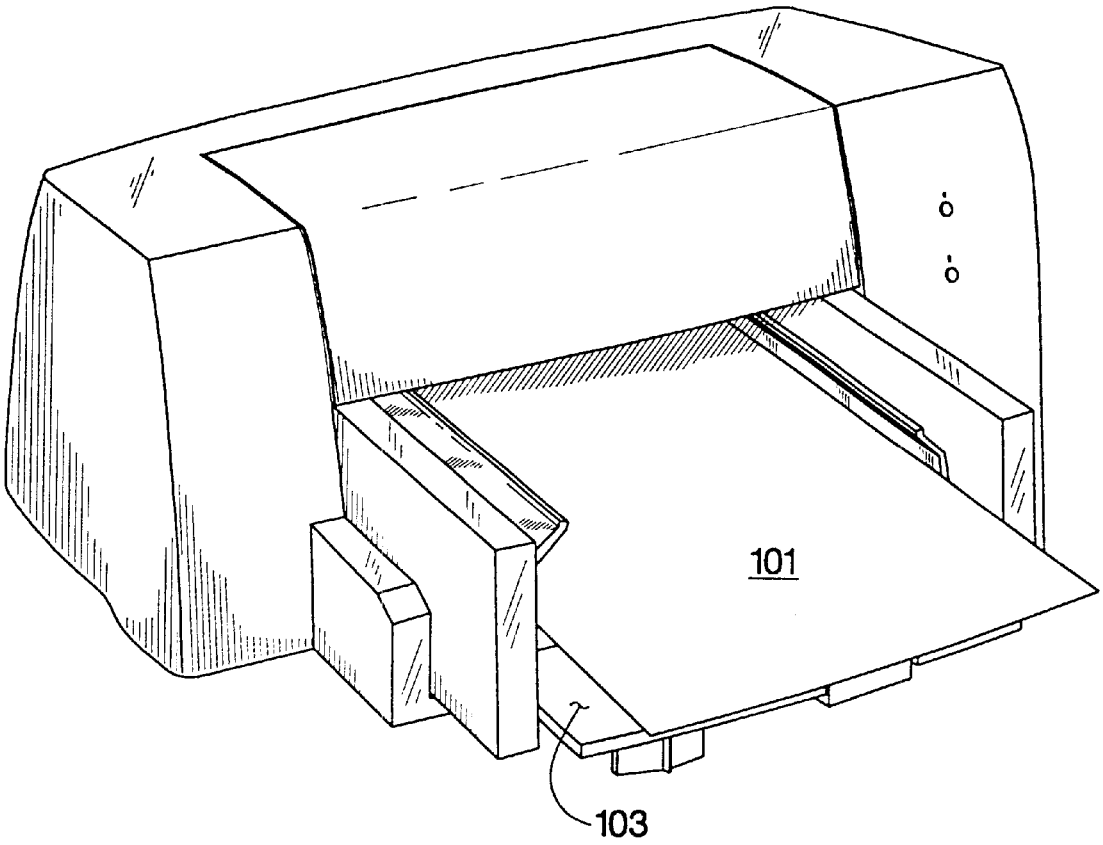
FIG. 1 is an isometric diagram of a printer which may benefit from the present invention.
Figure 2:
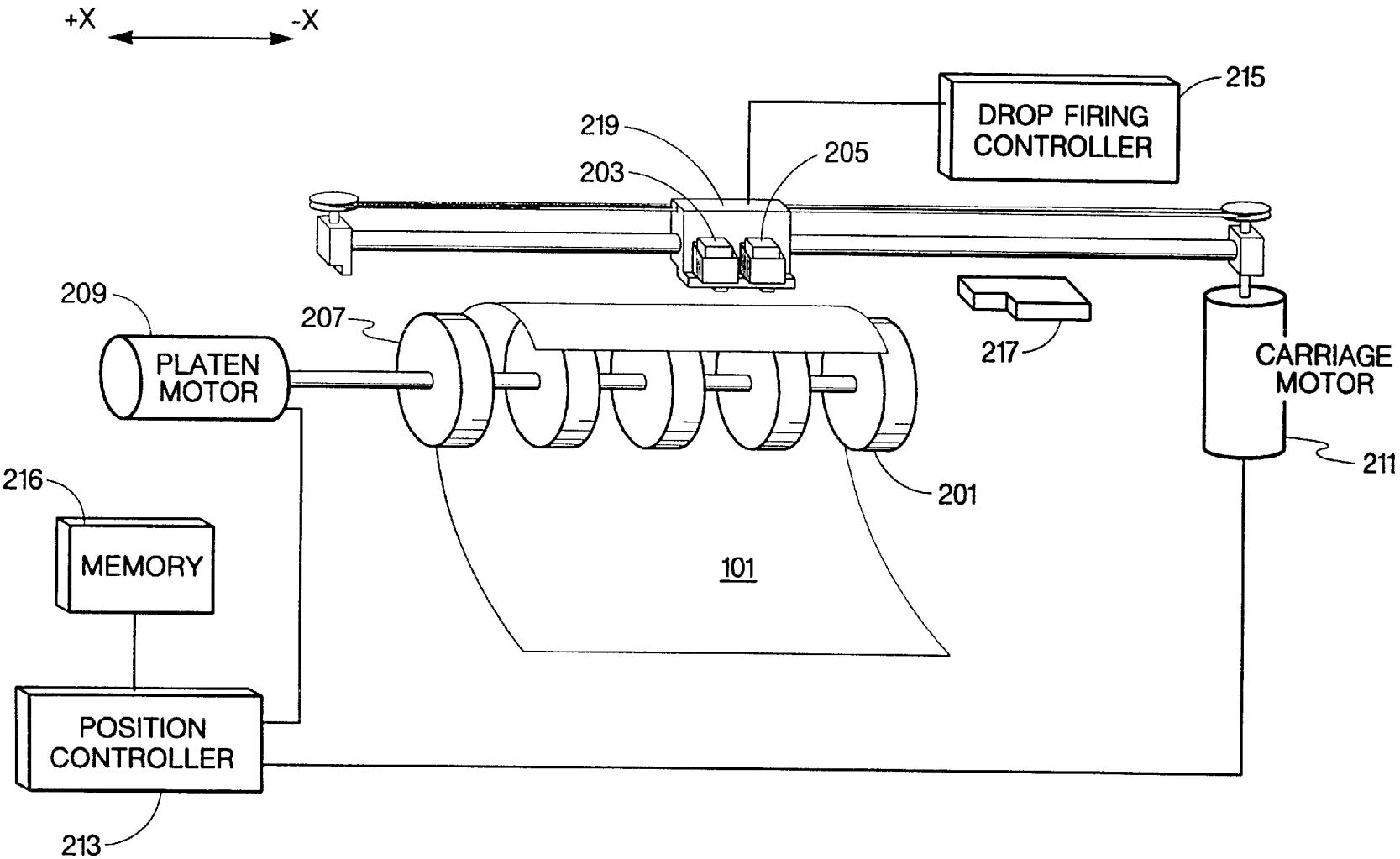
FIG. 2 is a block diagram of the printer of FIG. 1.

A uniquely designed cleaning kit for occasional use to supplement the automatic cleaning processes removes the ink and fiber residue from the print cartridge and cartridge carriage. The present invention encompasses such a cleaning kit and provides effective cleaning without damage to the sensitive structures of inkjet printing mechanism. An inkjet printer which may employ the present invention is illustrated in the isometric drawing of FIG. 1. While the illustrated printer is similar to a DeskJet model 692C available from Hewlett-Packard Company, other inkjet printers having different configurations and modes of operation may profitably benefit from the present invention. Paper or other media 101, which may be printed upon, is stored in the input tray 103. Referring to FIG. 2, a single sheet of media is advanced from a medium input 201 into a printer print area defined essentially by the printhead of inkjet print cartridges 203, 205 by a medium advancing mechanism including a roller 207, a platen motor 209, and traction devices (not shown). In a preferred embodiment, one or more inkjet print cartridges 203, 205 are incrementally drawn across the medium 101 on the platen by a carriage motor 211 in a direction perpendicular to the direction of entry of the medium. The platen motor 209 and the carriage motor 211 are typically under the control of a media and cartridge position controller 213. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 101 is positioned in a location so that the print cartridges 203 and 205 may eject droplets of ink to place dots on the medium as required by the data that is input to a drop firing controller 215 of the printer. These dots of ink are expelled from selected orifices in a printhead element of selected print cartridges in a band parallel to the scan direction as the print cartridges 203 and 205 are translated across the medium by the carriage motor 211. When the print cartridges 203 and 205 reach the end of their travel at an end of a print swath on the medium 101, the medium is typically incrementally advanced by the media and cartridge position controller 213 and the platen motor 209. Once the print cartridges have reached the end of their traverse in the X direction on a bar or other print cartridge support mechanism, they are either returned back along the support mechanism while continuing to print or returned without printing. The medium may be advanced by an incremental amount equivalent to the width of the ink ejecting portion of the printhead or some fraction thereof related to the spacing between the nozzles. Control of the medium, positioning of the print cartridge, and selection of the correct ink ejectors for creation of an ink image or character is determined by the controller 213. The controller may be implemented in a conventional electronic hardware configuration and provided operating instructions from conventional memory 216. Once printing of the medium is complete, the medium is ejected into an output tray of the printer for user removal. On a regular basis, the printhead is positioned adjacent a service station 217 for the nozzles to be cleared and for the printhead to be wiped clean of puddled ink and other debris. See for example "Color Thermal Inkjet Printer Electronics" by Jennie L. Hollis et al., Hewlett-Packard Journal, August 1988, pages 51–55; "Integrating the Printhead into the HP DeskJet Printer" by J. Paul Harmon et al., Hewlett-Packard Journal, October 1988, pages 62–66; and "DeskJet Printer Chassis and Mechanism Design", by Larry A. Jackson et al., Hewlett-Packard Journal, October 1988, pages 67–75.

In a preferred embodiment, two print cartridges are removably mounted on a print cartridge carriage 219 for transport in a +X and −X direction on a support rod. The printheads associated with each print cartridge are shown in the illustration of FIG. 2 as facing in a "down" orientation, facing the medium 101. A more detailed illustration is provided of the carriage in FIG. 3.

Figure 3:
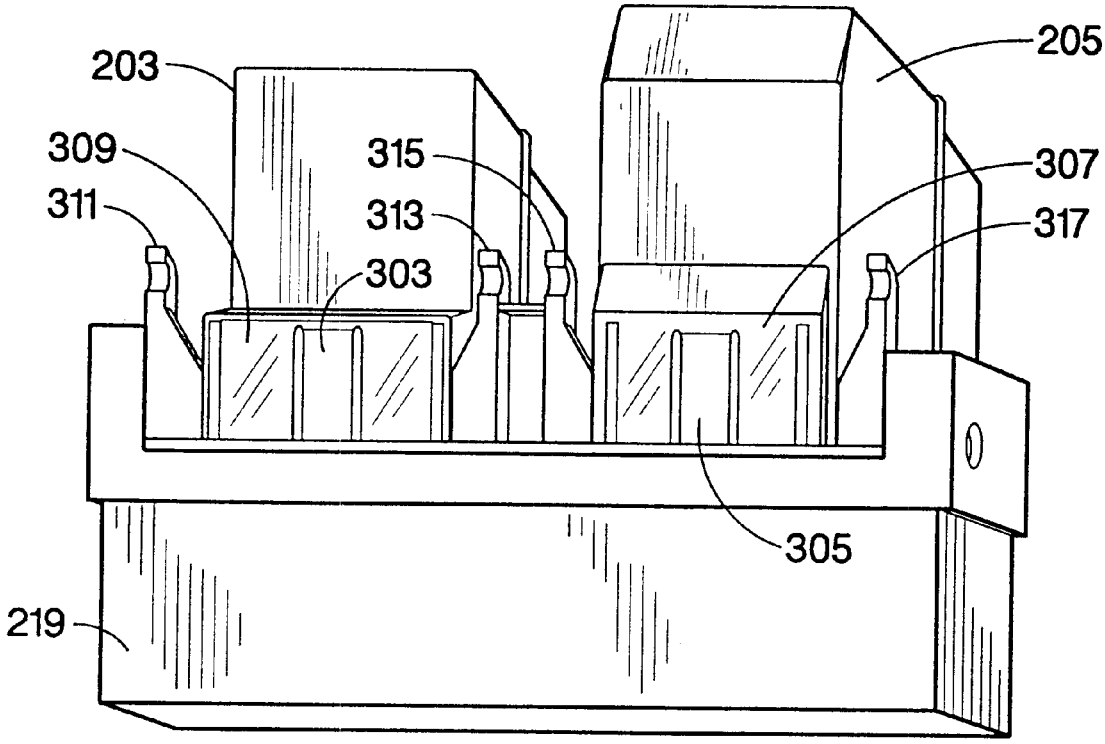
FIG. 3 is a simplified isometric diagram of a carriage for the printer of FIG. 1, illustrating the mounting of two inkjet print cartridges.

In the view of FIG. 3, the carriage has essentially been rotated about the axis of the support rod (not shown) so that the printheads 303, 305 of each cartridge may be viewed. Ink is stored in the body portion of each printhead 203, 205 and routed through internal passageways to the respective printhead. In an embodiment of the present invention which is adapted for multi-color printing, three groupings of orifices, one for each color (cyan, magenta, and yellow), is arranged on the surface of the printhead 305. Ink is selectively expelled for each color under control of commands from the printer that are communicated to the printhead 305 through electrical connections and associated conductive traces (not shown) on a flexible polymer tape 307. In the preferred embodiment, the tape 307 is typically bent around an edge of the print cartridge as shown and secured.

In a similar manner a single color ink is stored in the ink-containing portion of cartridge 203 and routed to a single grouping of orifices in printhead 303. Control signals are coupled to the printhead from the printer on conductive traces disposed on polymer tape 309.

Debris, consisting of dried or partially dried ink, paper fibers, dust, and other airborne particles, accumulates on the surfaces depicted in FIG. 3, particularly in areas around the printheads 303, 305, between the tapes 307, 309, in the latching and support mechanisms 311, 313, 315, 317, and in other crevasses of the print cartridge carriage 219. If the accumulations were found only on the print cartridge, merely removing the cartridge from the carriage (a process made simple because of the need to occasionally replace the cartridge when the ink has been depleted) and carefully cleaning the ink expelling end of the cartridge would suffice. The accumulation of debris on the carriage, however, presents a more problematic cleaning situation due to a more complicated mechanism and due to the space between the print head and the medium being very small. Because of the precision required for high quality, high resolution printing, the carriage is not easily removable. Efforts to swab away deposits with a cotton or fiber-tipped instrument are not always met with complete success. Therefore, a cleaning sheet having appropriate characteristics and following the path that media to be printed upon follows through the printer provides a cleaning of the surfaces most likely to come in close proximity to the medium. It is an important feature of the present invention that appropriate characteristics for cleaning an inkjet printer be incorporated in a useful cleaning sheet.

Figure 4:
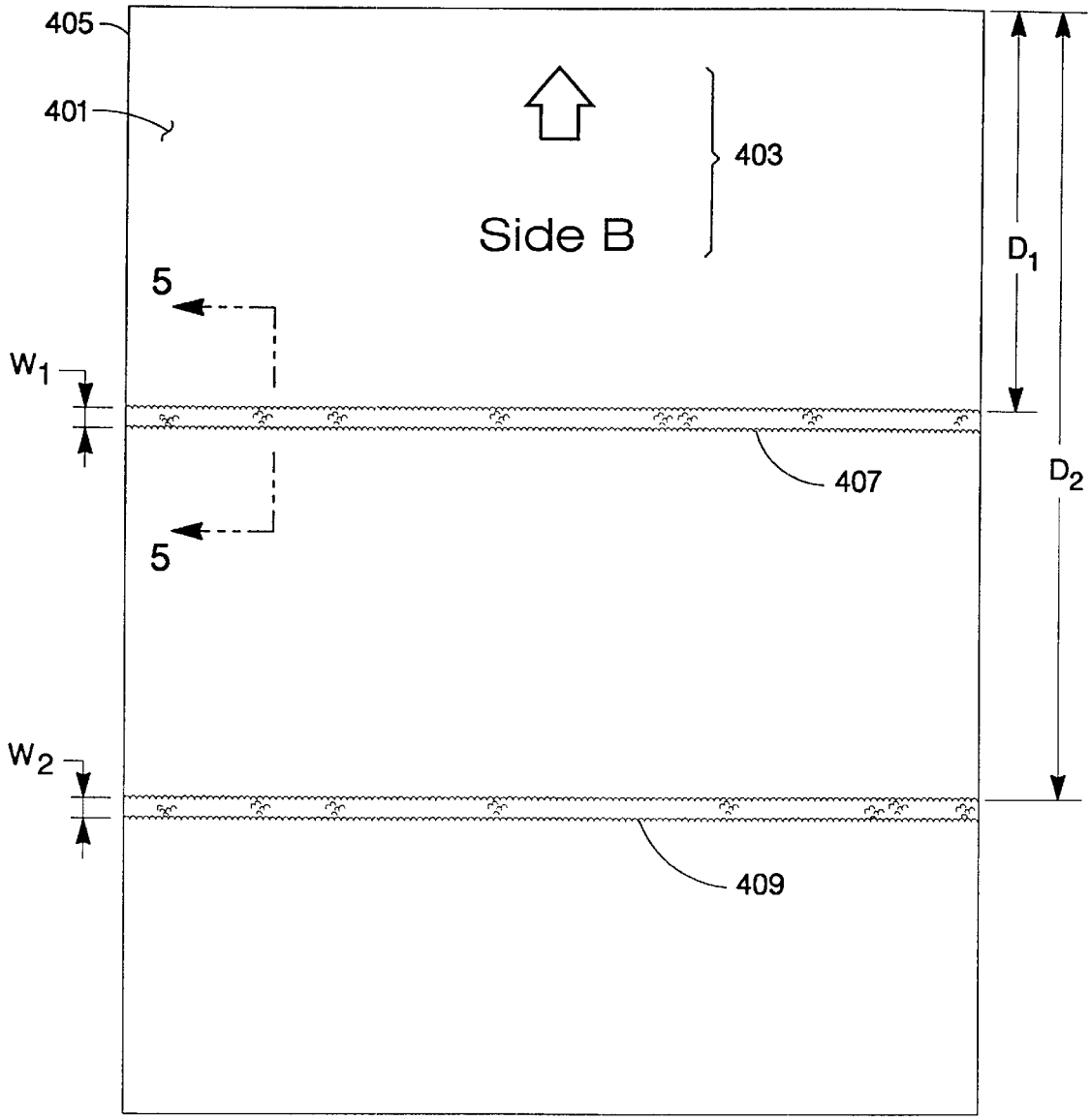
FIG. 4 is an illustration of a cleaning sheet which may employ the present invention.

A preferred embodiment of a cleaning sheet particularly adapted for an inkjet printer is shown in FIG. 4. A single sheet 401 of 24 lb. paper having standard 8½ by 11 inch (21.6 by 27.9 cm) dimensions or equivalent is employed as the basic medium. Other types of paper or similar media having a thickness equivalent to a paper weight range of 20 lb to 24 lb may also be used. Directions and graphically presented instructions 403 to aid the user in properly using the cleaning sheet are preferably printed on at least one side of the cleaning sheet. Affixed to the sheet 401 are two strips of material having a raised soft, downy texture—a napped surface. Such a surface can be realized with a soft brush-like fiber having a blunt or curved free end, or a soft loop of fiber secured at both ends of the loop. Each strip can be of a different nap configuration, such as one strip of material having fibers with curved free ends to snag well entrenched debris from crevasses and another strip of blunt free end bristles to brush away debris. In a preferred embodiment, both strips of material are composed of a soft loop nap which is available from Velcro USA, Inc. as part number LP2000/0172. It has been discovered that such material will wick ink from the nozzles of the printhead, the ink-retaining back pressure of the print cartridge notwithstanding, and use the wet ink as a solvent to dissolve deposits of dried ink. Furthermore, the closed loops provide a nonabrasive surface which is an important characteristic for a cleaning mechanism used with sensitive structures. If additional volumes of ink are necessary, the printhead will be caused to eject ink onto the material strip by the firing of ink from the orifices.

In a preferred embodiment, the material strips extend across the narrow (8½ inch) dimension of the sheet 401 essentially from one side edge to the other side edge. This configuration places the strips parallel to the sheet edge which is first fed into the printer (the sheet feed edge 405). In a preferred embodiment, the lengths of both strips are equal at 8.5 inch (21.6 cm) providing no space at the edge of the medium. Alternatively, strips shorter than the full width of the medium are used and are preferrably placed equidistant from the side edges. Although it is preferred that the strips of equal length be placed equidistant from the side edges, the lengths of the strips can be unequal or placed with a side-to-side offset without deviating from the scope of the present invention. Moreover, another alternative embodiment encompasses the use of one or more material strips oriented vertically on the medium and placed at selected locations on the medium to avoid contamination of inks between two or more cartridges.

The strips are affixed to the sheet 401 with an acrylic adhesive (in layer 501) to obtain good adhesion and long storage life in a wide range of environmental conditions. It is important that the strips be placed a controlled distance from the sheet feed edge 405 for reasons which will be explained below. The trailing edge of the first strip 407 is located a distance, $D_1+W_1$, equal to 4.49 inches±0.04 inch (114 mm±1 mm) from the sheet feed edge and the trailing edge of the second strip 409 is located a distance, $D_2+W_2$, equal to 8.31 inch±0.04 inch (211 mm±1 mm) from the sheet feed edge. In a preferred embodiment, both the first strip 407 and the second strip 409 are of equal widths, $W=W_1=W_2$, a dimension of 0.25 inch (6.35 mm). An alternative embodiment uses different width dimensions for each strip, dimensions better suited for distinctive uses such as snagging or brushing.

Figure 5:
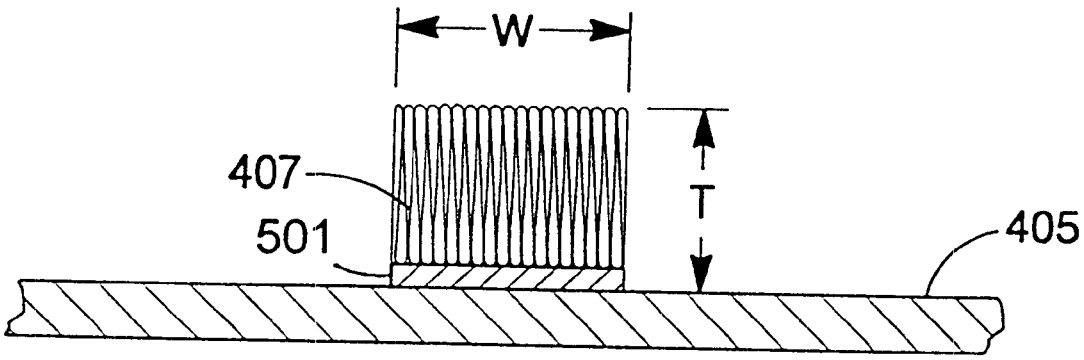
FIG. 5 is a cross section of the cleaning sheet of FIG. 4 through the section 5—5.

A feature of the strips is that the thickness of each strip is large enough to affirmatively contact the printhead and other areas of the print cartridge and carriage while not so large that the cleaning sheet will not feed into, or not become lodged in, the media advancing mechanism of the printer. The thickness dimension is readily apparent in the cross sectional diagram of FIG. 5. For those printers which have a printhead to medium spacing of 0.02 to 0.08 inch (0.5 to 2 mm); the thickness of the strip, T, is approximately 0.12 inch (3 mm). Other printhead to medium spacing requires a different thickness strip, preferably utilizing values of T in the range of 1.25 to 6 times the printhead to medium spacing.

In a preferred embodiment, the printer itself participates in the cleaning process to an extent greater than simply passing the cleaning sheet through the media feed path. Since the primary use of the cleaning sheet is to clean inkjet printers, and since a majority of inkjet printers use a reciprocating printhead on a carriage, it is a feature of the present invention that the printhead and carriage are reciprocated while in contact with the material strips of the cleaning sheet.

The printer is provided a set of instructions which are stored in a memory, such as memory 216. When executed, these instructions cause the printer to intake the cleaning sheet 401 (which has been placed in the input tray 103 by the user—desirably in accordance with the preprinted instructions to orient the side of the sheet upon which the material strips have been affixed in the correct direction to put the material strips into contact with the print cartridge and carriage when the cleaning sheet has been advanced into the printer) onto the roller 207. The position controller 213 rotates the roller a predetermined rotational distance equivalent to the distance $D_1+W_1-2$ mm (the distance first material strip 407 is spaced from the sheet feed edge 405 of the cleaning sheet plus the width of the strip less a margin for tolerance). This positioning places the first material strip immediately beneath the printhead of the print cartridge. It can be appreciated that the distance $D_1$ is used to enable a secure engagement of the cleaning sheet by the printer media advancing mechanism before the bulk of the increased thickness of the first material strip is encountered. This lead-in distance $D_1$ reduces the likelihood of cleaning sheet jamming within the printer.

Figure 6:
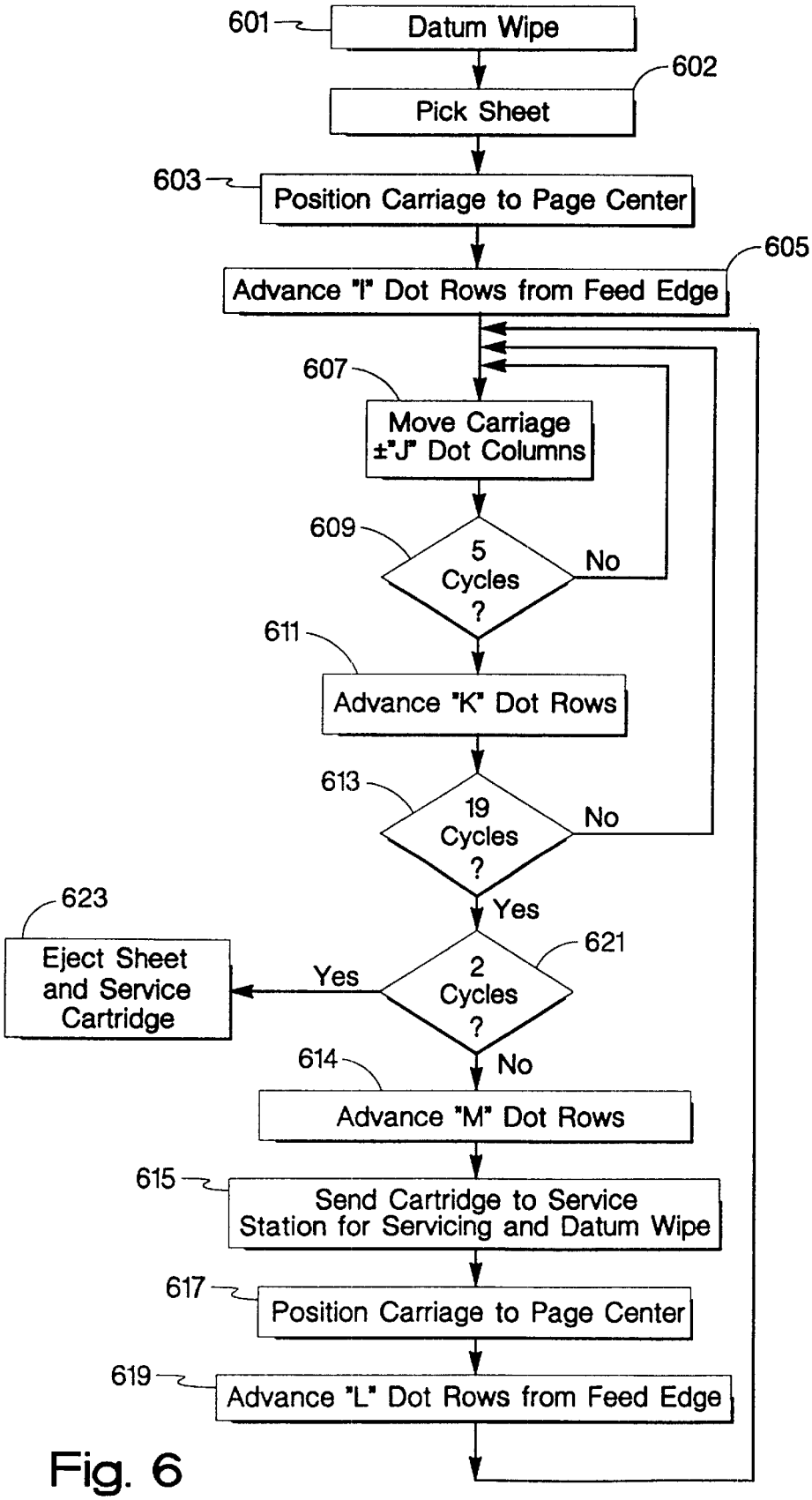
FIG. 6 is a flowchart of a process of cleaning the carriage, print cartridge, and printhead of the printer of FIG. 1.

A simplified flowchart of the instruction set executable by the printer is shown in FIG. 6. Prior to inputting the cleaning sheet, a special cleaning is instituted for the print cartridge at the printer service station 217. In addition to a conventional orifice-clearing spitting and an orifice plate wipe, the service station is instructed, at datum wipe, 601, to wipe the other surfaces of the print cartridge and carriage which face a medium to be printed upon. The step of picking the sheet at 602 brings the cleaning sheet into the printer. The print cartridge and carriage is positioned at the center of its range of reciprocation at 603 in preparation for cleaning. The roller 207 is advanced "I"=1320 dot rows (equivalent to 4.4 inches or 112 mm) from the sheet feed edge 405 at 605 to place the printhead of the print cartridge over the first material strip 407. It should be understood that when printing, the printer conventionally moves the medium in the direction the medium is fed into the printer in discrete increments that are related to the spacing between ink-expelling nozzles in the printhead. This type of position control provides a high resolution printer the ability to precisely locate the positions of the dots printed upon the medium. The carriage containing the print cartridge is then reciprocated by the position controller 213 and the carriage motor 211 plus and minus "J"=85 dot columns (0.28 inches, 7.2 mm) a total of five times, at 607, 609. For those printers which have two or more cartridges located on the carriage, provision must be made in the strip length. In a preferred embodiment, the minimum strip length to accommodate two print cartridges is established at 70 mm. It is, of course, possible to use a carefully positioned shorter strip of material to reduce the amount of material used in each cleaning sheet. In a first embodiment, production costs of careful alignment outweigh the cost of material used so an edge-to-edge strip is used. In an alternative embodiment, the printer is first caused to print a box on a medium without strips to outline the optimum position for strips to be placed in a subsequent manual operation. Once the strips have been placed in the printed boxes, the cleaning medium is re-inserted into the printer for continuation of the cleaning process.

Returning to the cleaning process detailed in the flow chart of FIG. 6, the cleaning sheet is advanced from the position of first scrubbing of the print cartridge by the position controller 213 and the platen motor 209 a distance of "K"=10 dot rows (0.033 inches, 0.85 mm) at 611, whereupon the carriage is reciprocated plus and minus J dot columns five times, advanced another K dot rows, and reciprocated again. In the preferred embodiment, a total of 19 such dot row advancements each with five carriage cycle reciprocations is accomplished for one strip of material, determined at 613.

In a preferred embodiment, the print cartridge is then advanced "M" dot rows at 614, (where M=100 rows, 0.33 inch, 8.5 mm) to clear the material strip and avoid ink contamination of inks on the printheads. The print cartridge is sent to the service station 217 for nozzle clearing and a special datum wipe wiping of the printhead and carriage, at 615. Following this servicing, the printhead is returned to the cleaning sheet page center, at 617. To further clean the printhead, print cartridge, and carriage, the cleaning sheet is advanced, at 619, to a distance, $D_2+W_2-2$ mm, from the sheet feed edge 405, where $D_2+W_2-2$ mm is 8.23 inches, 209.0 mm (equivalent to"L"=2468 dot rows) from the sheet feed edge. This distance places the printhead over the second material strip 409. In the preferred embodiment, the second material strip is positioned far enough along the direction of medium feed direction from the first material strip that the first material strip has completely cleared the printer medium feed mechanism before the second material strip enters the printer feed mechanism. This spacing avoids the likelihood that both material strips are in the printer feed mechanism at the same time. This can result in a jamming of the cleaning sheet in the printer. The cartridge is reciprocated ±J dot columns for five cycles before the cleaning sheet is advanced K dot rows a total of nineteen cycles. Upon completion of the nineteen cycles, the cleaning sheet is ejected from the printer at 621, 623 and a servicing of the print cartridge is again instituted.

Thus, a cleaning sheet and a process of cleaning an inkjet printer has been described to enable the removal of debris and dried ink from print cartridges and their carriage without damage to the sensitive structures of the inkjet printing mechanisms.

We claim:

1. A method of cleaning an inkjet printer having a print cartridge carriage supporting a print cartridge, comprising the steps of:

picking a medium comprising a sheet feed edge and a napped strip of material disposed in a predetermined location on a surface of said medium;

advancing said medium a first distance into the inkjet printer to position the print cartridge in contact with said napped strip of material; and reciprocating the print cartridge carriage a predetermined distance in a direction perpendicular to a direction of medium advancement in the inkjet printer when the print cartridge is positioned against said napped strip of material.

2. A method in accordance with the method of claim 1 further comprising the steps of:

advancing said medium a second distance into the inkjet printer; and subsequently moving the print cartridge carriage while the print cartridge remains positioned against said napped strip of material.

3. A method in accordance with the method of claim 2 wherein said medium further comprises a second napped strip of material disposed in a second predetermined location on said surface of said medium, said method further comprising the steps of:

advancing said medium a third distance into the inkjet printer to position the print cartridge in contact with said second napped strip of material; and moving the print cartridge carriage when the print cartridge is positioned against said second napped strip of material.

4. A method in accordance with the method of claim 3 further comprising the steps of:

advancing said medium a fourth distance into the printer; and subsequently moving the print cartridge carriage while the print cartridge remains positioned against said second napped strip of material.

5. A method in accordance with the method of claim 1 further comprising the step of performing a datum wipe of a print cartridge surface before said picking step.

6. A method in accordance with the method of claim 1 further comprising the step of ejecting said medium from the inkjet printer.

7. A method in accordance with the method of claim 1 further comprising step of printing information on said medium.

* * * * *